US006053797A

United States Patent [19]

Tsang et al.

[11] Patent Number: 6,053,797

[45] Date of Patent: Apr. 25, 2000

[54] INTERACTIVE TOY

[75] Inventors: Henry H. T. Tsang, Richmond Hill; Jeff Mak, Brampton, both of Canada

[73] Assignee: Eastgate Innovations Incorporated, Mississauga, Canada

[21] Appl. No.: 09/118,370

[22] Filed: Jul. 17, 1998

[51] Int. Cl.[7] ..... A63H 3/28

[52] U.S. Cl. ..... 446/297

[58] Field of Search ..... 446/297

[56] References Cited

U.S. PATENT DOCUMENTS

| | | | |
|---|---|---|---|
| 4,028,276 | 6/1977 | Harden et al. | 252/513 |
| 4,249,338 | 2/1981 | Wexler | 446/297 X |
| 4,820,236 | 4/1989 | Berliner et al. | 446/369 |
| 5,011,449 | 4/1991 | Handy et al. | 446/297 |
| 5,288,069 | 2/1994 | Matsumoto | 473/570 |
| 5,376,038 | 12/1994 | Arad et al. | 446/297 |
| 5,795,213 | 8/1998 | Goodwin | 446/297 |
| 5,820,440 | 10/1998 | Truchsess | 446/297 X |

FOREIGN PATENT DOCUMENTS

| | | | |
|---|---|---|---|
| 537924-A1 | 4/1993 | European Pat. Off. . | |
| 549840 | 7/1993 | European Pat. Off. | 446/297 |

*Primary Examiner*—John A. Ricci
*Attorney, Agent, or Firm*—Ingrid E. Schmidt

[57] ABSTRACT

An interactive toy programmed to respond in different ways to mechanical stimulation depending on the level and kind of applied stimulation. The toy includes a body and an electronic circuit coupled to the body which electronic circuit may be connected to a power source for supplying electric current to the circuit. The circuit includes a sensor arranged in association with the body, which sensor is responsive to mechanical stimulation to produce a signal dependent on the nature and degree of the mechanical stimulation. A signal recognition and processing device is coupled to the sensor, which device is for processing the signal to produce a command. An output device is, in turn, coupled to the signal recognition and processing device, which output device is for carrying out a programmed response in response to the command. The sensor is an elastomeric variable resistor composition including an elastomer in which are embedded conductive particles. Mechanical stimulation of the sensor alters its resistance to create the signal which is processed by the signal recognition and processing device to give rise to the programmed response when the circuit is connected to the power source.

13 Claims, 9 Drawing Sheets

RUBBING

POUNDING

PRESSING

PATTING

INTERACTIVE TOY

FIELD OF THE INVENTION

The present invention relates to toys, and more particularly to interactive toys programmed to respond to mechanical stimulation.

BACKGROUND OF THE INVENTION

Conventional toys include dolls, plush animals, three-dimensional representations of cartoon or comic book characters, toy trucks and cars, and the like. Many toys resemble inanimate objects, not capable of interacting with a person during play. Other toys are interactive insofar as they are adapted to respond to input from a person.

For example, U.S. Pat. No. 4,820,236 to Berliner et al. discloses a soft doll within which is mounted a flexible piezoelectric sensor adjacent to an outer surface thereof. The sensor generates an electric signal when subjected to stress effective in bending the sensor, which signal is processed by a central processing unit to produce predetermined speech from a speech synthesizer in the doll.

U.S. Pat. No. 5,011,449 teaches a doll having bend sensors mounted to appendages such as arms to produce signals varying with the degree of bending or displacement of the arms. The signals are processed to give rise to varying vocalizing sounds.

The sensors of dolls taught by the above patents, though flexible, are limited in the number of configurations they may assume. For instance, the sensors cannot be twisted or stretched to produce signals which lead to the production of programmed responses. Further, the sensors do not function as decorative elements, being mounted internally.

It is therefore an object of the present invention to provide a new and improved more intelligent interactive toy utilizing sensors which can be stimulated in more ways to produce a larger number of different signals leading to a great variety of different programmed responses. Another object is to provide a toy having sensors which can be variously mounted including externally as a decorative feature where the sensors can be stimulated directly in order to produce a programmed response.

SUMMARY OF THE INVENTION

The present invention provides an interactive toy programmed to respond to mechanical stimulation. The toy includes a body and an electronic circuit coupled to the body and adapted to be connected to a power source for supplying electric current to the circuit. The circuit includes a sensor arranged in association with the body, which sensor is responsive to mechanical stimulation to produce a signal dependent on the nature and degree of the mechanical stimulation. A signal recognition and processing device is coupled to the sensor, which device is for processing the signal to produce a command. An output device is, in turn, coupled to the signal recognition and processing device, which output device is for carrying out a programmed response in response to the command. The sensor is an elastomeric variable resistor composition including an elastomer in which are embedded conductive particles. Mechanical stimulation of the sensor alters its resistance to create the signal which is processed by the signal recognition and processing device to give rise to the programmed response when the circuit is connected to the power source.

An advantage of the invention is that it provides a more intelligent interactive toy for adding a higher level of realism to play.

BRIEF DESCRIPTION OF THE DRAWINGS

A preferred embodiment of the invention will now be described with reference to the drawings in which like reference numerals denote like parts and in which.

DESCRIPTION OF THE PREFERRED EMBODIMENT

Figure 1:
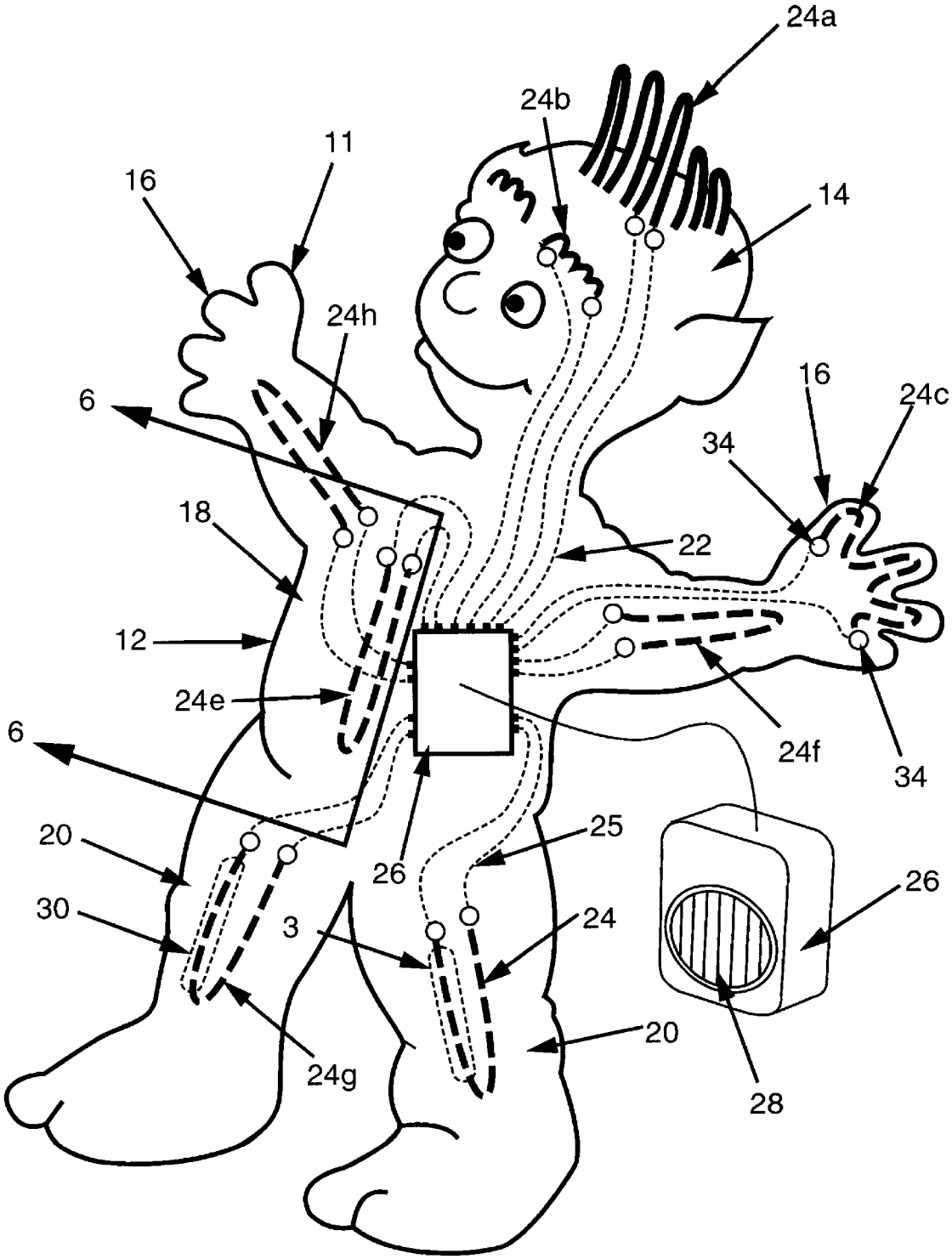
FIG. 1 is a simplified isometric view of an interactive plush doll according to the preferred embodiment with hidden structure shown in chain-dotted outline.

Referring to FIG. 1, an interactive toy in the form of a plush doll designated generally by numeral 10 is programmed to respond to mechanical stimulation. The doll 10 has a soft body designated generally by numeral 12, including an outer layer in the form of a fabric shell 11 and stuffing which occupies room in the fabric shell 11 to lend shape to the body 12 which is divided into portions forming, among other parts, a head 14, hands 16, a tummy 18 and legs 20. The doll 10 further includes an electronic circuit designated generally by numeral 22 embedded in the body 12 and connected to a power source in the form of a battery (not shown) contained within a housing 26. The electronic circuit includes sensors 24*a–h*, responsive to mechanical stimulation to produce a signal dependent on the nature and degree of the mechanical stimulation, and arranged in association with the body 12. Also included is a signal recognition and processing device contained within the housing 26, for processing signals produced by the sensors 24 to produce commands. The signal recognition and processing device is in the form of a circuit board containing integrated circuits including an analog to digital converter and a microprocessor programmed by software. The analog to digital converter is connected to the sensors 24*a–h* by conductive wiring designated generally by numeral 25. The housing 26 also contains an output device in the form of a speaker 28 coupled to the microprocessor and actuated by the microprocessor's commands to emit sound responses. The speaker 28 emits a variety of different sounds at varying volumes depending upon the nature and degree of mechanical stimulation applied to the sensors 24*a–h*. This is achieved through the use of elastomeric variable resistors as sensors in the doll 10.

In order to understand the material of sensors 24*a–h*, reference is made to U.S. Pat. No. 4,028,276 to Harden which discloses pressure-sensitive elastic resistor compositions including the composition of sensors 24*a–h*. The material of sensors 24*a–h* is of natural rubber in which are dispersed conductive carbon particles. Mechanically stimulating the sensors 24*a–h* by applying pressure or stress thereto alters their resistance. Electrical signals are produced in association with the change in resistance. The characteristics of any signal produced are dependent on the nature and degree of mechanical stimulation applied.

The analog to digital converter analyzes the signal and translates it into data which is then inputted to the microprocessor contained in housing 26. The microprocessor, in turn, processes the data in accordance with its software program to issue a data-dependent command which actuates the speaker to produce a specific sound response.

The microprocessor is programmed to issue a number of different commands for each of sensors 24*a–h* depending on the magnitude and nature of stimulation applied. Thus, for example, stimulating hair sensor 24*a* in different ways or at different intensities can give rise to different sounds. Furthermore, different sensors 24*a–h* are connected to the microprocessor through different electrical channels. The microprocessor is programmed to distinguish between the different channels so as to issue different commands resulting in different output responses when different sensors are stimulated. This is so even when different sensors 24*a–h* are mechanically stimulated to produce similar signals. Thus, stimulating each of sensors 24*a–h* results in a different respective sound being produced.

Different ways of mounting the sensors 24*a–h* together with exemplary kinds of mechanical stimulation and responses will now be described with reference to FIGS. 2–6.

FIGS. 2*a* to 2*e* show hair sensor 24*a* having ends 32*a* attached to metal connectors 34*a* which are, in turn, connected to respective input and output wires 36*a* of the conductive wiring 25. The sensor 24*a* extends from its ends 32*a* through the fabric shell 11 to outside of the body 12 in a looped configuration and is therefore exposed for direct physical stimulation and is a decorative feature of the doll 10.

Figure 2A:
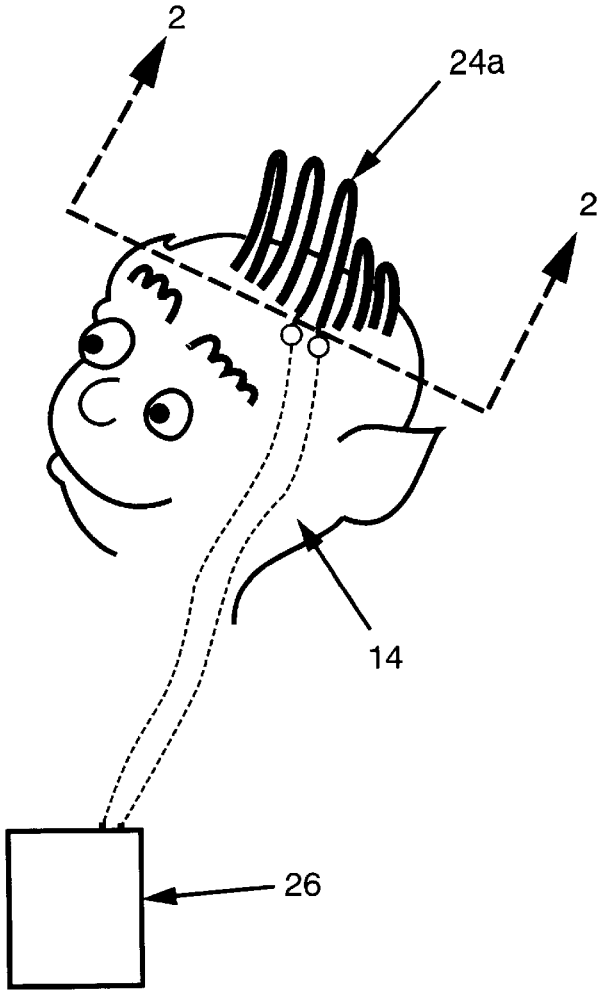
FIG. 2*a* is a partial isometric view of the doll of FIG. 1 showing a head.
Figure 2B:
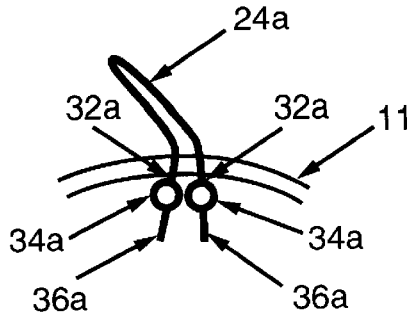
FIGS. 2*b–e* are enlarged partial sectional views taken generally on line 2—2 of FIG. 2*a* showing a hair sensor in a variety of stimulated positions.
Figure 2C:
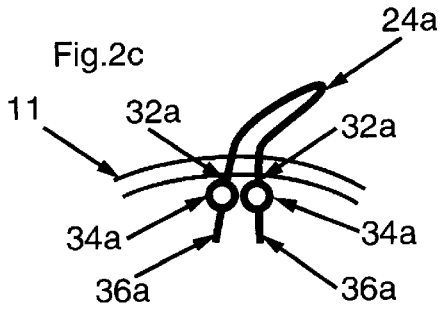
Figure 2D:
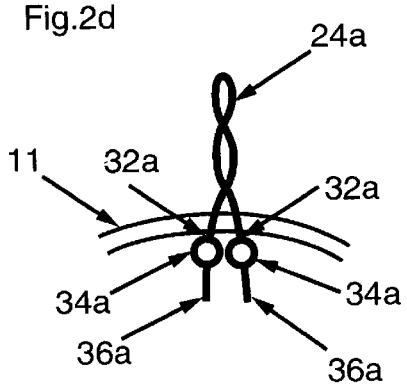
Figure 2E:
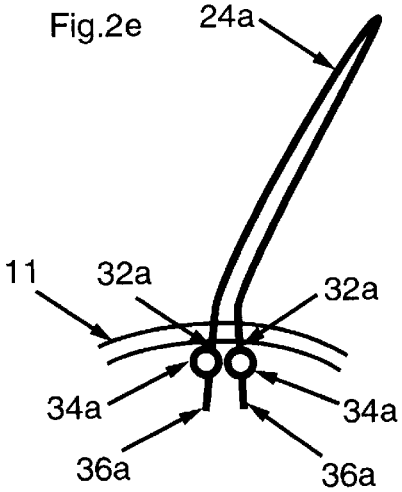

FIGS. 2*b–e* show hair sensor 24*a* stimulated in a variety of exemplary ways to produce exemplary responses. FIGS. 2*b* and 2*c* show the sensor 24*a* bent in a similar fashion towards different directions, to produce similar signals resulting in the same sound, "Aaww shucks!" Twisting the hair sensor 24*a*, as shown in FIG. 2*d*, produces a different signal to generate the sound, "Oooww!" Stretching the hair sensor 24*a* vigorously, as illustrated in FIG. 2*e*, produces a signal similar to the signal produced by twisting but of a higher magnitude and is therefore processed by the integrated circuits to produce the sound, "Stop that, it hurts!"

FIGS. 3*b* to 3*e* show eyebrow sensor 24*b* which, like hair sensor 24*a*, has ends 32*b* connected to respective input and output wires 36*b* via metal connectors 34*b* underneath the fabric shell 11. The sensor 24*b* is mounted differently than sensor 24*a*, having respective portions along its length extending outside, through and inside of the fabric shell 11 in a generally regular pattern to simulate the eyebrows of the doll 10. Like the hair sensor 24*a*, external portions of eyebrow sensor 24*b* can be stimulated directly and are decorative features of the doll 10.

Figure 3A:
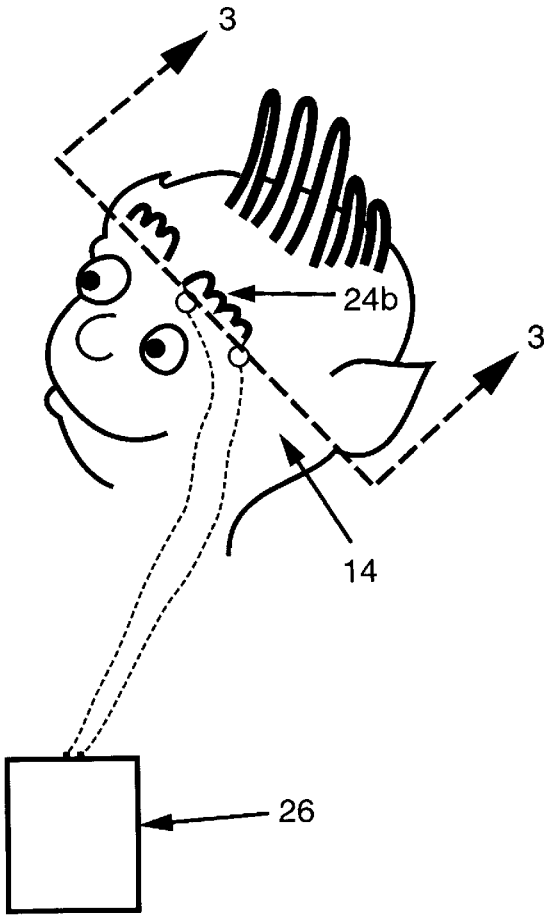
FIG. 3*a* is a partial isometric view of the doll of FIG. 1 showing the head.
Figure 3B:
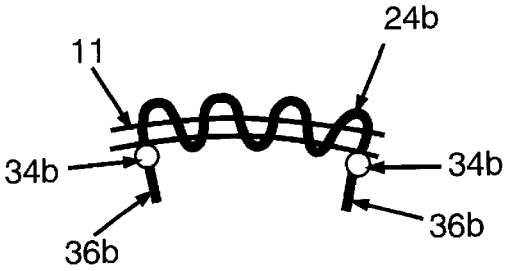
FIG. 3*b* is an enlarged partial sectional view taken generally on line 3—3 of FIG. 3*a* showing an eyebrow sensor in an unstimulated position.
Figure 3C:
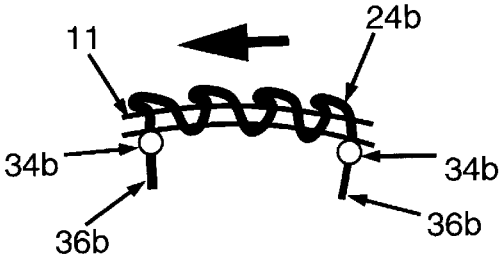
FIGS. 3*c–e* are views similar to the view of FIG. 3*b* showing the eyebrow sensor in a number of stimulated positions.
Figure 3D:
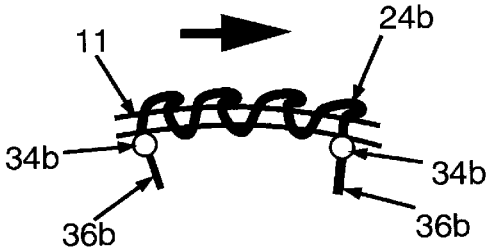
Figure 3E:
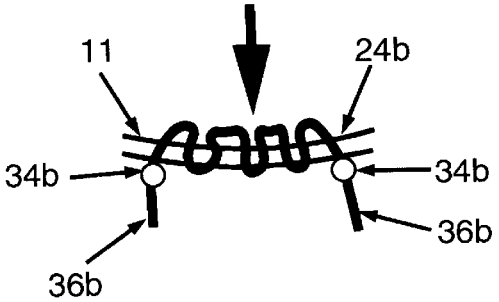

FIG. 3*b* shows the sensor 24*b* in an unstimulated position producing no response. FIGS. 3*c* and 3*d* show the sensor 24*b* rubbed left and right to produce the sound, "Ha, ha, ha!" Pressing down on the eyebrow sensor 24*b* for several seconds (as illustrated by FIG. 3*e*) produces the sound, "Hey! What are you doing?"

So far, sensors having portions external to the body have been described in detail. Now, sensors 24*c–h* concealed within the soft body portions of the doll 10 will be described. With respect to these sensors 24*c–h*, physical stimulation of the soft body portions in turn causes mechanical stimulation of the sensors 24*c* to 24*h*.

Figure 4A:
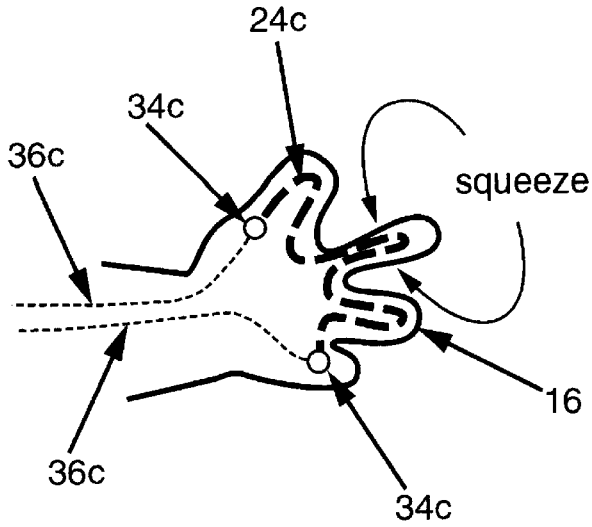
FIGS. 4*a–c* are partial isometric views of the doll showing a hand including a hand sensor mechanically stimulated in a number of different ways.
Figure 4B:
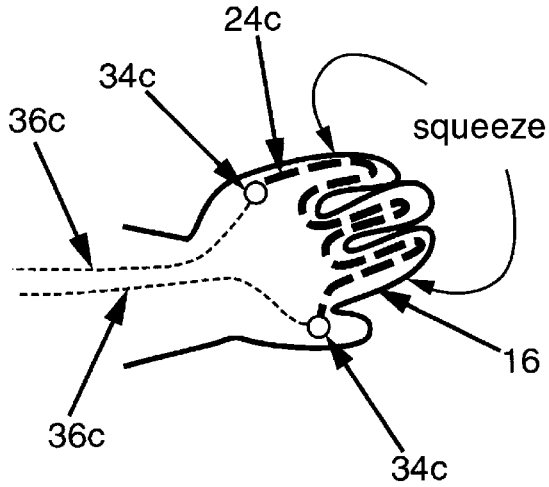
Figure 4C:
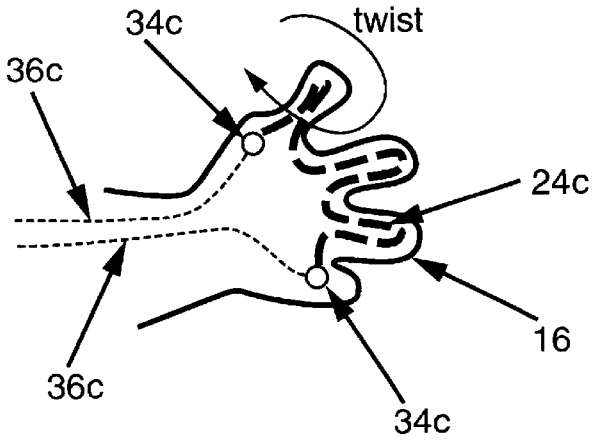

Reference will now be made to FIGS. 4*a* to *c* which show a soft hand 16 in which is mounted a finger sensor 24*c*. The finger sensor 24*c* is formed in loops with each loop being disposed in a respective finger and maintained in position by stitching to the fabric shell 11. The stitching of the sensor 24*c* in place allows for greater consistency of response since the sensor is prevented from migrating to another position or configuration which would affect the signals produced by the sensor 24*c*.

FIGS. 4*a* to 4*c* illustrate exemplary ways of stimulating the fingers. Squeezing one finger produces the sound, "Yooww!" (FIG. 4*a*). Squeezing all the fingers more vigorously produces an even louder "Yeeooowww!!" (FIG. 4*b*). Both actions produce similar signals but the action of squeezing all the fingers more vigorously produces a signal of greater magnitude which is processed to produce a louder yell. Twisting a finger, as illustrated by FIG. 4*c*, creates a different type of signal which leads to the sound, "Ooww, ooww, ooww, ooww!!"

Figure 5A:
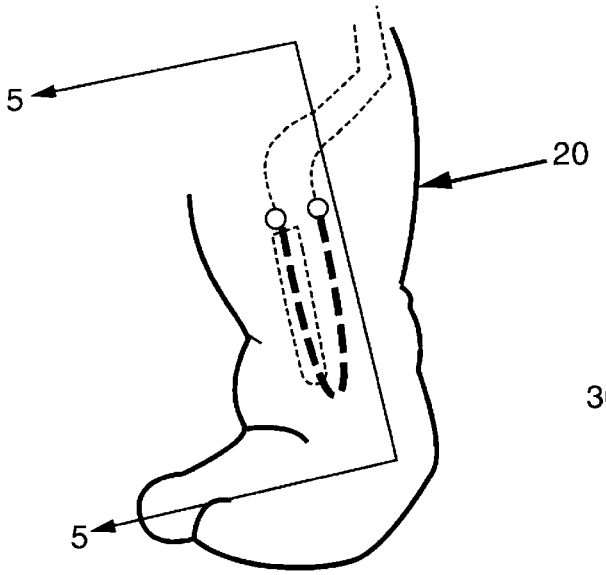
FIG. 5*a* is a partial isometric view of the doll showing a leg.
Figure 5B:
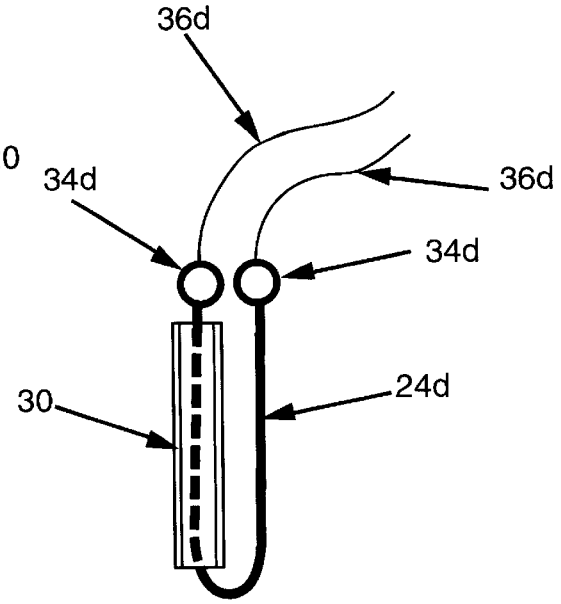
FIG. 5*b* is a partial isometric view of an internal component of the leg showing, among other things, a leg sensor.
Figure 5C:
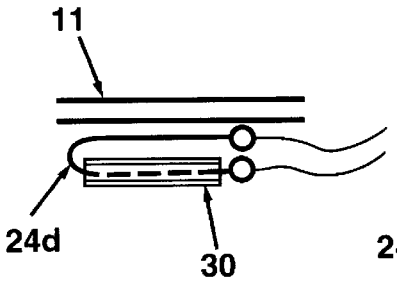
FIGS. 5*c–f* are partial sectional views taken generally on line 5—5 of FIG. 5*a* showing the leg sensor in a variety of positions.
Figure 5D:
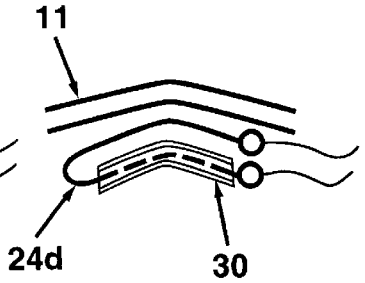
Figure 5E:
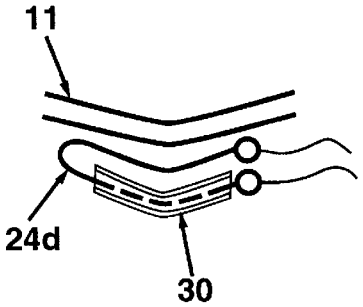
Figure 5F:
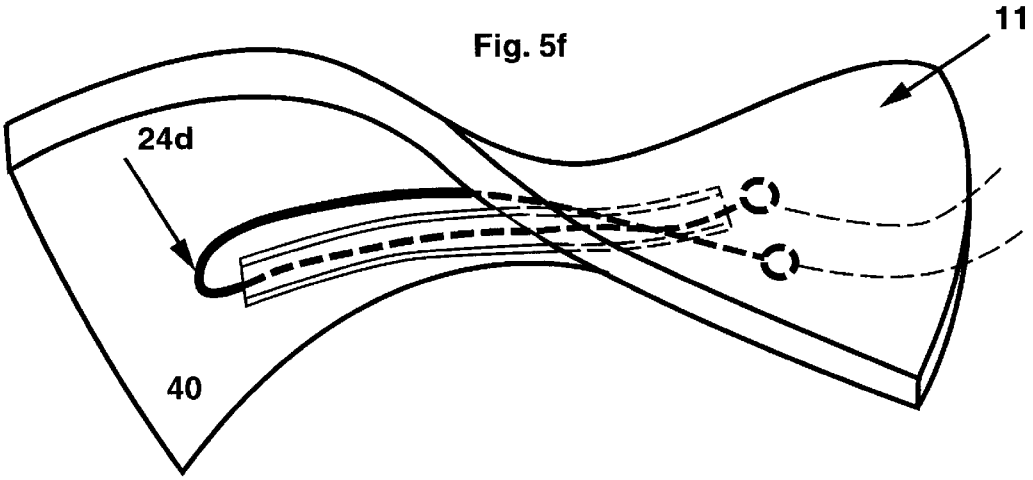

FIG. 5*a* shows leg sensor 24*d* having a part thereof threaded through a vinyl sleeve 30 which is sewn to an inner surface 40 of the fabric shell 11 (FIG. 5*f*). The vinyl sleeve 30 locates the leg sensor 24*d* in a fixed location in the leg 20 and in a predetermined looped path such that a more consistent response may be generated from a particular stimulus.

Exemplary positions of the leg sensor 24*d* are shown in FIGS. 5*c* to 5*f*. No response will be obtained when the sensor is at rest, as shown in FIG. 5*b*. Bending and releasing sensor 24*d* quickly produces an "Oh yeah!" Bending and holding sensor 24*d* in a bent position for several seconds produces an "Aaahh!" (FIGS. 5*d* and 5*e*). Twisting the leg 20 produces a "Yikes!" (FIG. 5*f*).

Figure 6A:
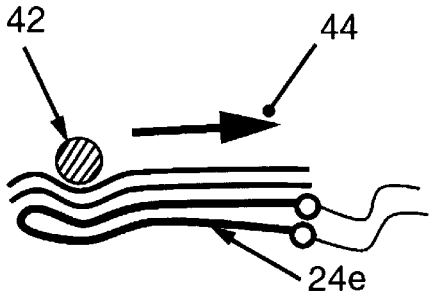
FIGS. 6*a–e* are partial sectional views of the doll taken generally on line 6—6 of FIG. 1 showing a tummy sensor being rubbed.
Figure 6B:
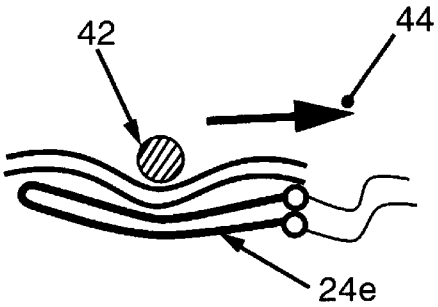
Figure 6C:
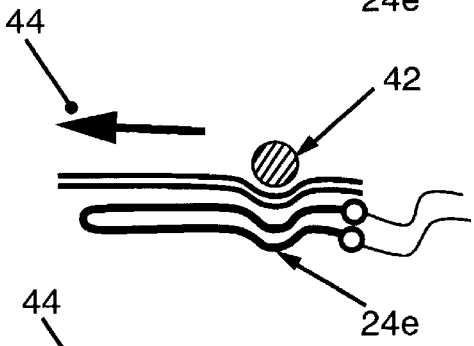
Figure 6D:
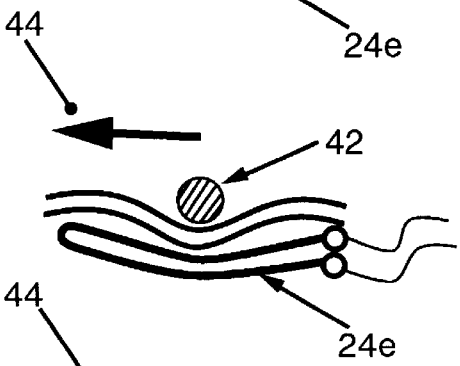
Figure 6E:
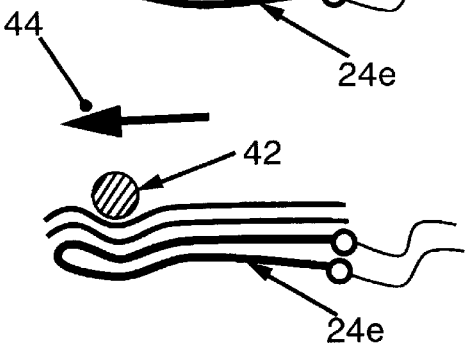
Figure 6F:
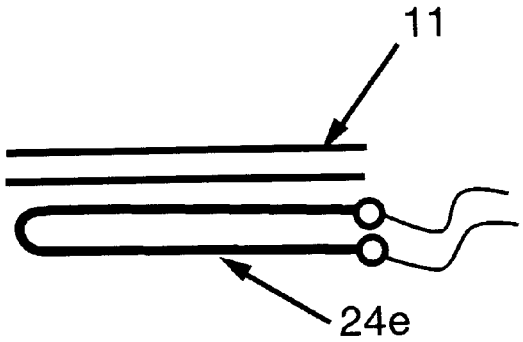
FIGS. 6*f–h* are views similar to the views of FIGS. 6*a–e* showing the tummy sensor being pounded.
Figure 6G:
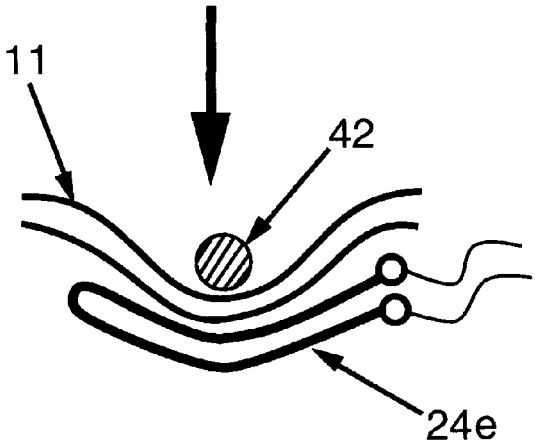
Figure 6H:
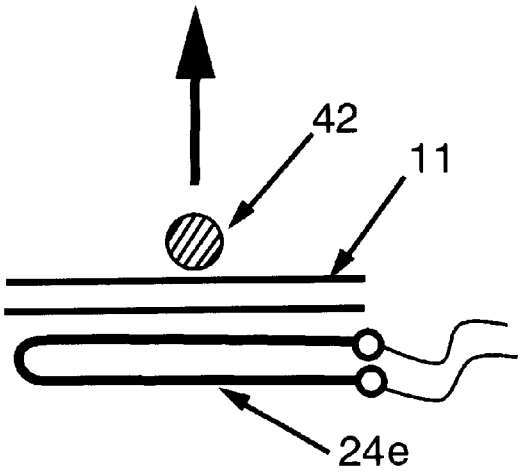
Figure 6I:
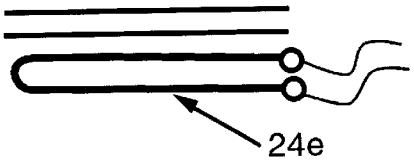
FIGS. 6*i* and 6*j* are views similar to the views of FIGS. 6*a–e* showing the tummy sensor being pressed.
Figure 6J:
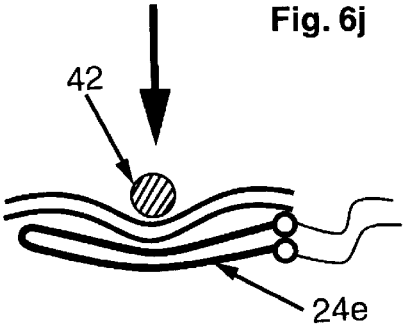
Figure 6K:
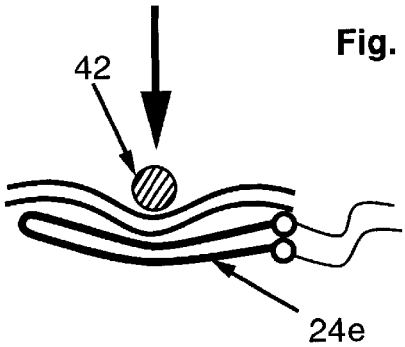
FIGS. 6*k–n* are views similar to the views of FIGS. 6*a–e* showing the tummy sensor being patted.
Figure 6L:
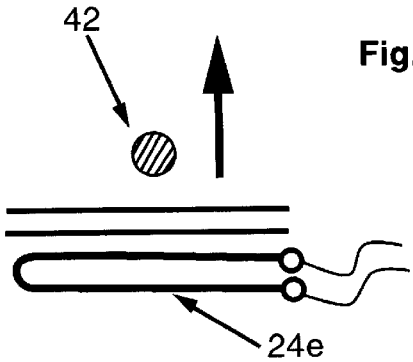
Figure 6M:
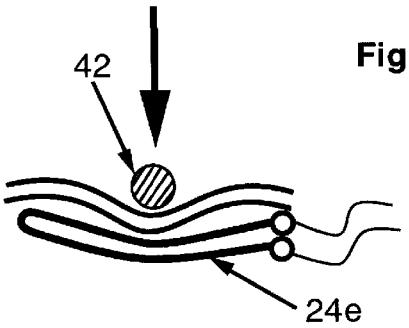
Figure 6N:
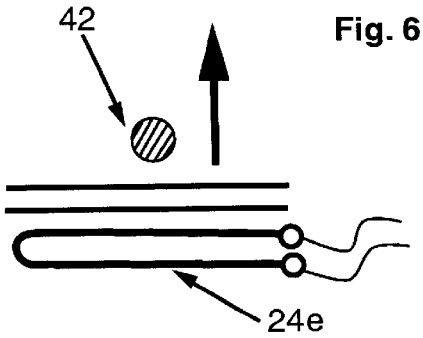

FIGS. 6*a–n* show a tummy sensor 24*e* laid in a looped configuration directly adjacent to and along inner surface 40 of a portion of the fabric shell 11 at the tummy 18 of the doll 10. The tummy sensor 24*e* is secured in position by stitching (not shown) to allow for consistency of response.

FIGS. 6*a* to 6*n* illustrate exemplary ways of mechanically stimulating the tummy sensor 24*e* with an object in the form of a hand 42 shown in schematic. A rubbing action illustrated by FIGS. 6*a* to 6*e* can be understood by following the motion of the hand 42 in the direction of arrow 44 through FIGS. 6*a* to 6*e* in sequence. The microprocessor is programmed to distinguish between the action of rubbing back and forth once as compared to rubbing back and forth several times such that different sounds are produced in connection with these different actions.

FIGS. 6*f–h* illustrate the action of pounding the tummy sensor 24*e* while FIGS. 6*i–j* illustrate the action of pressing. In both cases, the signal produced is similar. However, differences in magnitude of stimulation are detected and processed to give rise to different sounds.

FIGS. 6*k* to 6*n* illustrate the action of patting the tummy sensor 24*e* which is similar to repeated pressing. Once again, the microprocessor is programmed to distinguish between a single action, such as pressing (FIGS. 6*i–j*), and a repeated action, such as patting (FIGS. 6*k–n*) such that different responses may be obtained.

Leg sensor 24*g* (FIG. 1) is mounted in similar fashion to leg sensor 24*d* described above and has similar characteristics except that stimulation of leg sensor 24*g* gives rise to responses different from the responses generated by stimulating leg sensor 24*d*. For example, bending the right leg to stimulate leg sensor 24*g* gives rise to "Oooh, that feels nice, but could you rub my tummy?"

Arm sensors 24*f* and 24*h* (FIG. 1) are mounted in similar fashion to tummy sensor 24*e* and give rise to different responses. For example, shaking the right arm to actuate arm sensor 24*h* produces the sound, "Hello there, nice to meet you." Shaking the left arm in a similar fashion generates the sound, "Arghh, arghh, arghh, arghh!"

Figure 7A:
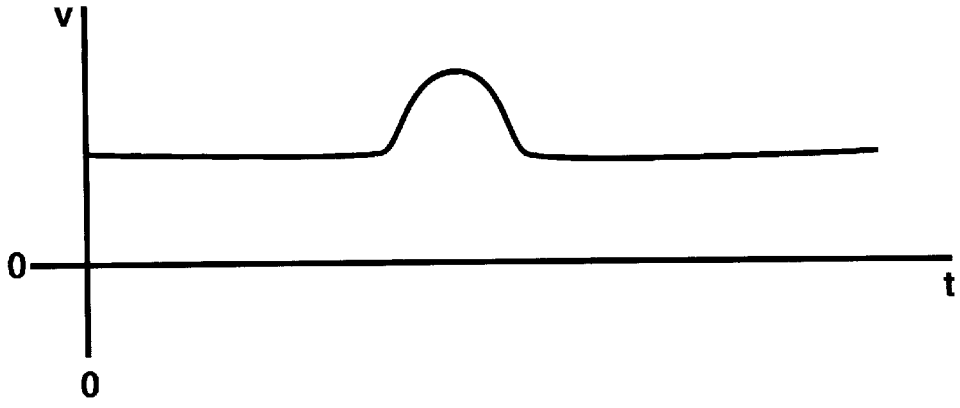
FIGS. 7*a–c* are exemplary graphical representations of signals produced by sensors of the doll when subjected to various kinds of mechanical stimulation.
Figure 7B:
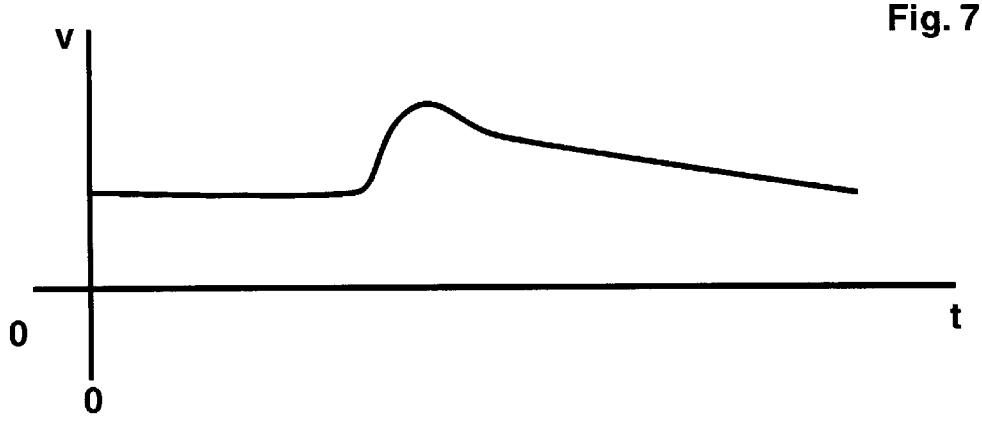
Figure 7C:
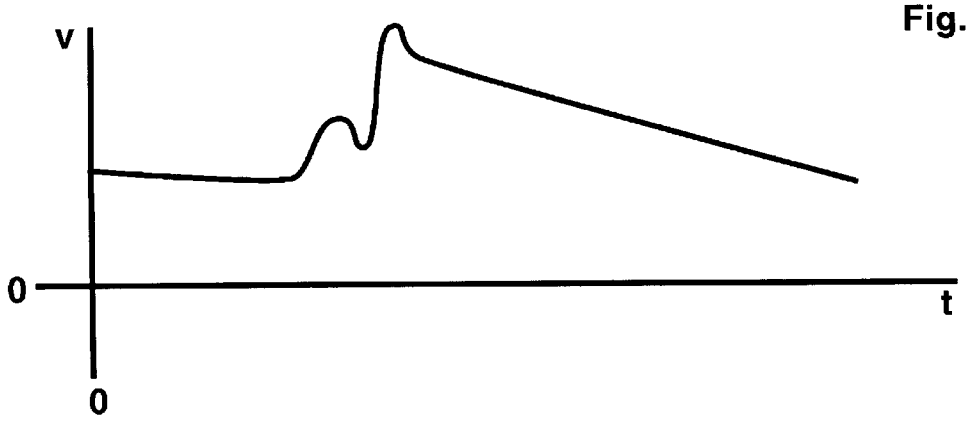

FIGS. 7*a* to 7*c* illustrate exemplary wave forms of signals generated by the different mechanical stimuli described above, which signals are expressed in terms of voltage as a function of time.

FIG. 7*a* illustrates a typical signal produced by a quick squeezing, bending, folding, pounding, rubbing or pressing action. FIG. 7*b* illustrates a typical signal produced by a prolonged squeezing, bending, folding, pounding, rubbing or pressing action. FIG. 7*c* illustrates an exemplary signal produced by twisting or stretching the sensors 24*a–h*.

In sum, the doll 10 responds in different ways to different levels or intensities of the same kind of mechanical stimulation, as well as to certain different kinds of mechanical stimulation of the same or similar intensity. Further, the doll 10 can produce a different response depending on which sensor is being stimulated. Finally, the doll 10 can respond differently depending on whether a particular action is a single action or a repeated action.

It is to be understood that the foregoing description is by way of example only and is not meant to limit the scope of the appended claims. For example, instead of using an analog to digital converter, the signals produced by the sensors may be translated into data by means of pulse width modulation, or by way of voltage control frequency.

Further, the toy may be entirely hard containing only sensors having portions exposed externally.

While the programmed response in the preferred embodiment is a sound emanating from a speaker, alternative programmed responses include the moving of parts of a toy, the turning on and off of lights, and so forth.

Also, sensors may be mounted entirely externally of the body of a toy, as in the case of exposed metal connectors. The sensors may further be of any elastomeric variable resistor composition such as but not limited to those compositions disclosed in U.S. Pat. No. 4,028,276 to Harden et al. The sensors may also be of any shape such as circular, square, triangular, and so forth rather than being thin and elongated. Likewise, the sensors may be of any size suitable for the particular application.

It will be apparent to those skilled in the art that a great many variations to the preferred embodiment may be obtained without departing from the spirit and scope of the present invention as defined by the following claims.

We claim:

1. An interactive toy programmed to respond to mechanical stimulation comprising a body;

an electric circuit coupled to the body and adapted to be connected to a power source for supplying electric current to the circuit, said electronic circuit having a sensor arranged in association with said body, said sensor being responsive to mechanical stimulation to produce an analog signal dependent on the nature and degree of the mechanical stimulation;

a signal recognition and processing device coupled to said sensor for processing said analog signal to produce a command;

an output device coupled to said signal recognition and processing device for carrying out a programmed response in response to the command;

wherein said sensor is an elastomeric variable resistor composition comprising an elastomer in which are embedded conductive particles, and whereby mechanical stimulation of said sensor alters the resistance of said sensor to create said analog signal giving rise to said programmed response when said circuit is connected to a power source, said response being variable and dependent on the nature and degree of mechanical stimulation of said sensors.

2. An interactive toy according to claim 1 wherein said body comprises a soft body portion, said sensor being concealed within said soft body portion such that physical stimulation of said soft body portion in turn causes mechanical stimulation of said sensor.

3. An interactive toy according to claim 1 wherein said output device comprises a speaker and said programmed response is a sound emitted by said speaker.

4. An interactive toy according to claim 1 wherein said programmed response is different for a different signal produced by said sensor.

5. A toy according to claim 1 comprising a plurality of said sensors.

6. A toy according to claim 5 wherein said programmed response is different for a different sensor.

7. A toy according to claim 1 wherein said electronic circuit is adapted to be connected to a battery.

8. A toy according to claim 1 in which said body is a representation of a living, animate object and said programmed response simulates a normal action of animate objects in nature.

9. An interactive toy programmed to respond to mechanical stimulation comprising a body;

an electronic circuit coupled to the body and adapted to be connected to a power source for supplying electric current to the circuit, said electronic circuit having a sensor arranged in association with said body, said sensor being responsive to mechanical stimulation to produce an analog signal dependent on the nature and degree of the mechanical stimulation;

a signal recognition and processing device coupled to said sensor for processing said analog signal to produce a command;

an output device coupled to said signal recognition and processing device for carrying out a programmed response in response to the command;

wherein said sensor is an elastomeric variable resistor composition comprising an elastomer in which are embedded conductive particles, said sensor including an external portion external to said body and exposed for direct mechanical stimulation, whereby mechanical stimulation of said sensor alters the resistance of said sensor to create said analog signal giving rise to said programmed response when said circuit is connected to a power source, said response being variable and dependent on the nature and degree of mechanical stimulation of said sensors.

10. A toy according to claim 9 in which said external portion is a decorative feature of the toy.

11. An interactive toy according to claim 9 further comprising a sleeve concealed within said soft body portion for receiving at least a portion of said sensor and locating said sensor in a fixed location in said soft body portion and in predetermined configuration.

12. An interactive toy according to claim 11 wherein said sleeve is flexible.

13. An interactive toy according to claim 11 wherein said soft body portion includes an outer layer having an inner surface, and said sleeve is attached to said inner surface.

* * * * *